US009290299B2

(12) United States Patent
McTavish et al.

(10) Patent No.: US 9,290,299 B2
(45) Date of Patent: Mar. 22, 2016

(54) SLIDING ENGAGEMENT FOR A STACKING DELIVERY TRAY

(75) Inventors: Gordon McTavish, Edmonton (CA); Hongqiao Li, Edmonton (CA); Steven Koski, Edmonton (CA)

(73) Assignee: Drader Manufacturing Industries Ltd., Edmonton (CA)

( * ) Notice: Subject to any disclaimer, the term of this patent is extended or adjusted under 35 U.S.C. 154(b) by 0 days.

(21) Appl. No.: 13/243,809

(22) Filed: Sep. 23, 2011

(65) Prior Publication Data

US 2012/0074022 A1 Mar. 29, 2012

(30) Foreign Application Priority Data

Sep. 24, 2010 (CA) ..... 2715552

(51) Int. Cl.
*B65D 21/02* (2006.01)
*B65D 21/04* (2006.01)

(52) U.S. Cl.
CPC ..... *B65D 21/0212* (2013.01); *B65D 21/043* (2013.01); *B65D 21/045* (2013.01)

(58) Field of Classification Search
USPC ..... 206/505, 509
See application file for complete search history.

(56) References Cited

U.S. PATENT DOCUMENTS 2,456,481 A * 12/1948 Ballantyne et al. ..... 34/238
2,599,727 A 6/1952 Schmidt
2,852,157 A 9/1958 Frater
2,889,072 A 6/1959 Lapham
3,270,913 A 9/1966 Bridenstine
3,326,410 A 6/1967 Asenbauer
3,331,529 A 7/1967 Slapnik
3,387,740 A 6/1968 Bockenstette
3,420,402 A 1/1969 Frater
3,430,806 A 3/1969 Munk
3,438,544 A 4/1969 Cloyd
3,675,815 A 7/1972 Rehrig
3,780,905 A * 12/1973 Herolzer ..... 206/507
4,000,817 A * 1/1977 Sanders et al. ..... 206/505
4,139,098 A 2/1979 Mollon
4,205,749 A 6/1980 Carroll
4,316,540 A 2/1982 Lapham
4,416,374 A 11/1983 Smith
4,426,001 A 1/1984 Stahl
4,960,207 A 10/1990 Tabler
5,035,326 A 7/1991 Stahl
5,287,966 A * 2/1994 Stahl ..... 206/509
5,344,022 A * 9/1994 Stahl ..... 206/507
5,881,902 A 3/1999 Ackermann
6,260,706 B1 * 7/2001 Koefelda ..... 206/505
6,273,259 B1 8/2001 Stahl
6,394,274 B1 5/2002 Cheeseman
D598,684 S 8/2009 Stahl (Continued)

FOREIGN PATENT DOCUMENTS

CA 2 276 863 A1 2/2000
CA WO 2006/089407 * 2/2006

*Primary Examiner* — Fenn Mathew
*Assistant Examiner* — Chetan Chandra
(74) *Attorney, Agent, or Firm* — Christensen O'Connor Johnson Kindness PLLC

(57) ABSTRACT

A sliding engagement is described for a stacking delivery tray having a sliding surface that has a break. The sliding engagement includes at least one ramp on the sliding surface providing an inclined sliding transition to an end of an overlying tray sliding along the sliding surface in order to traverse the break in the sliding surface.

3 Claims, 2 Drawing Sheets

(56) References Cited

U.S. PATENT DOCUMENTS

| | | | | |
|---|---|---|---|---|
| 7,699,172 | B2 | 4/2010 | McTavish | |
| 7,837,037 | B2 | 11/2010 | McTavish | |
| 7,861,864 | B2 * | 1/2011 | Hassell et al. | 206/507 |
| 2004/0060844 | A1 | 4/2004 | Stahl | |
| 2005/0183980 | A1 * | 8/2005 | Fernandez et al. | 206/509 |
| 2006/0070906 | A1 * | 4/2006 | Verna et al. | 206/509 |
| 2007/0187276 | A1 * | 8/2007 | Stahl | 206/505 |
| 2010/0230317 | A1 * | 9/2010 | Cook et al. | 206/505 |

* cited by examiner

SLIDING ENGAGEMENT FOR A STACKING DELIVERY TRAY

FIELD

There is described a sliding engagement for a stacking delivery tray having a sliding surface that has breaks.

BACKGROUND

U.S. Pat. No. 7,699,172 (McTavish et al.) entitled "Stacking Delivery Tray" discloses a stacking delivery tray that has two operative positions to accommodate different sizes of product. When these delivery trays are stacked, in order to add or remove an overlying tray, it must slide along the underlying tray. In a first or lower operative position, the overlying tray slides along a top shelf. In a second or higher operative position, the overlying tray slides along a top rail which is raised above the top shelf. In order to accommodate the two operative positions, the McTavish et al. stacking delivery tray has a top rail with breaks in it and a top shelf with breaks in it. These breaks are referred to by McTavish et. al as valleys. In view of this, it is difficult, if not impossible, to get a smooth linear sliding action along either the top rail or the top shelf. What is required is a modified sliding engagement which will facilitate a smoother more linear sliding relationship between the underlying tray and the overlying tray.

SUMMARY

There is provided a sliding engagement for a stacking delivery tray having a sliding surface that has breaks. The sliding engagement includes at least one ramp on the sliding surface providing an inclined sliding transition to an end of an overlying tray sliding along the sliding surface in order to traverse the break in the sliding surface.

With most stacking delivery trays, the point requiring transition is spaced from one or both of the ends. For this reason it is preferred that the at least one ramp is spaced from one end of the stacking delivery tray and has an upward incline toward said one end.

The problem with breaks in the sliding surface is most frequently found in two position stacking delivery trays. When the stacking delivery tray is a two position stacking delivery tray there are two sliding surfaces. A first sliding surface is in the form of a top shelf or ledge providing a lower operative position. A second sliding surface is in the form of a top rail that is parallel to, but raised above, the top shelf providing a higher operative position. There is at least one ramp on the top shelf providing an inclined sliding transition to an end of an overlying tray sliding along the top shelf in the lower operative position in order to traverse the break in the top shelf. There is at least one ramp on the top rail providing an inclined sliding transition to an end of an overlying tray sliding along the top shelf in the higher operative position in order to traverse a break in the top rail.

Although beneficial result may be obtained through use of the sliding engagement described above, the sliding engagement is improved even more when the at least one ramp on the top shelf also provides an inclined sliding transition to lift an end of an overlying tray sliding along the top rail in the higher operative position in order to traverse the break in the top rail. Similarly, the at least one ramp on the top rail also provides an inclined sliding transition to lower an overlying tray sliding along the top shelf in the lower operative position in order to traverse the break in the top shelf.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
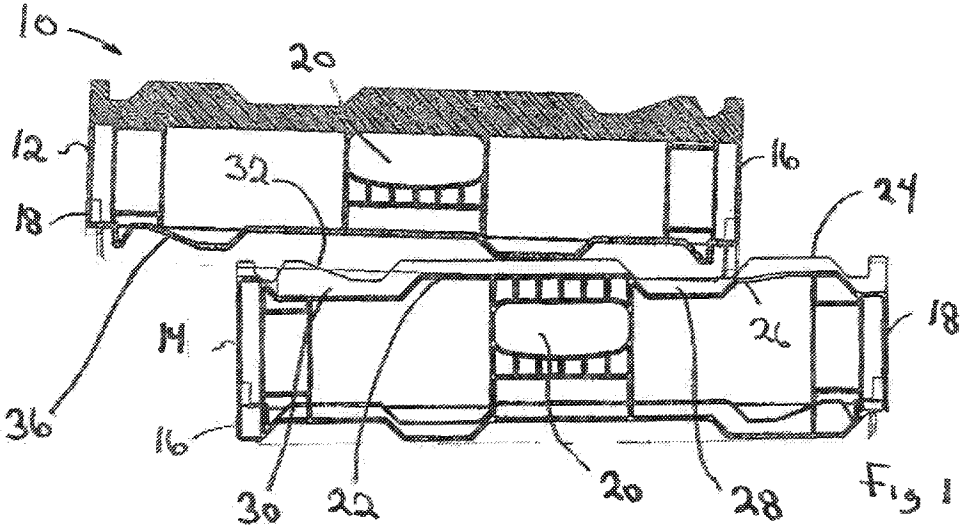
FIG. 1 is a side elevation view, in section, of a stacking tray in the lower operative position with top shelf ramp engaged.

A sliding engagement for a stacking delivery tray having a sliding surface with breaks will now be described with reference to FIGS. 1 through 4. A two position stacking delivery tray has been selected for illustration, as it is a more complex form of tray. However, it will be appreciated that the principles described are equally applicable to a single height stacking delivery tray.

Structure and Relationship of Parts:

Referring to FIG. 1 through FIG. 4, there is illustrated a sliding engagement generally referenced by numeral 10 for a two position stacking tray. There is illustrated an overlying stacking tray 12 and an underlying stacking tray 14. Overlying stacking tray 12 and underlying stacking tray 14 are identical in size and shape, each having a first end 16, a second end 18, a handle opening 20, a top shelf 22, a top rail 24, and first and second bottom surfaces 34 and 36 that are complementary to top shelf 22 and top rail 24. As will be hereinafter further explained, top shelf 22 and top rail 24 provide sliding surfaces. However, those sliding surfaces are "irregular" or stated another way are "non-linear" as both have a break 28 toward second end 18 and a break 30 toward first end 16, where the "valleys" of the engagement profile are located.

Figure 2:
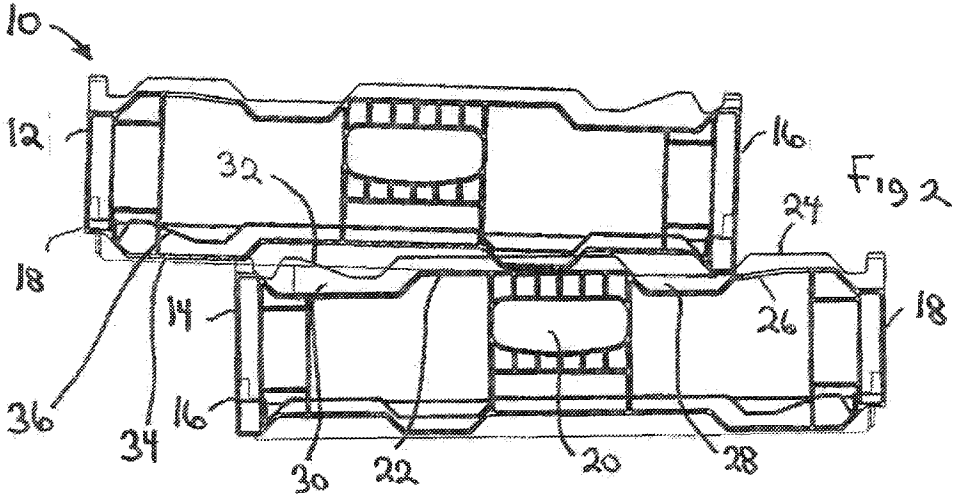
FIG. 2 is a side elevation view, in section, of a stacking tray in the lower operative position showing an upper tray engaging the top shelf and the top rail.
Figure 3:
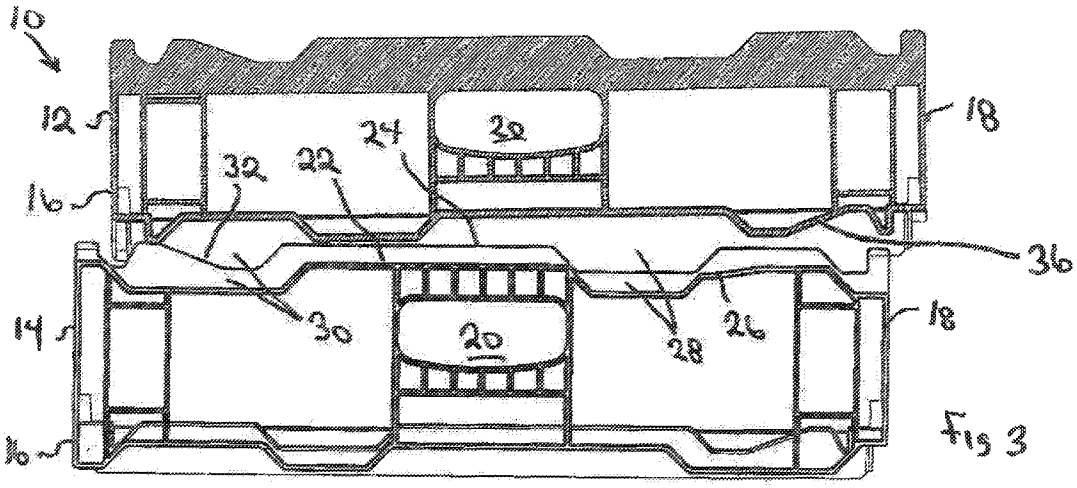
FIG. 3 is a side elevation view, in section, of a stacking tray in a higher operative position showing an upper tray engaging the top rail.
Figure 4:
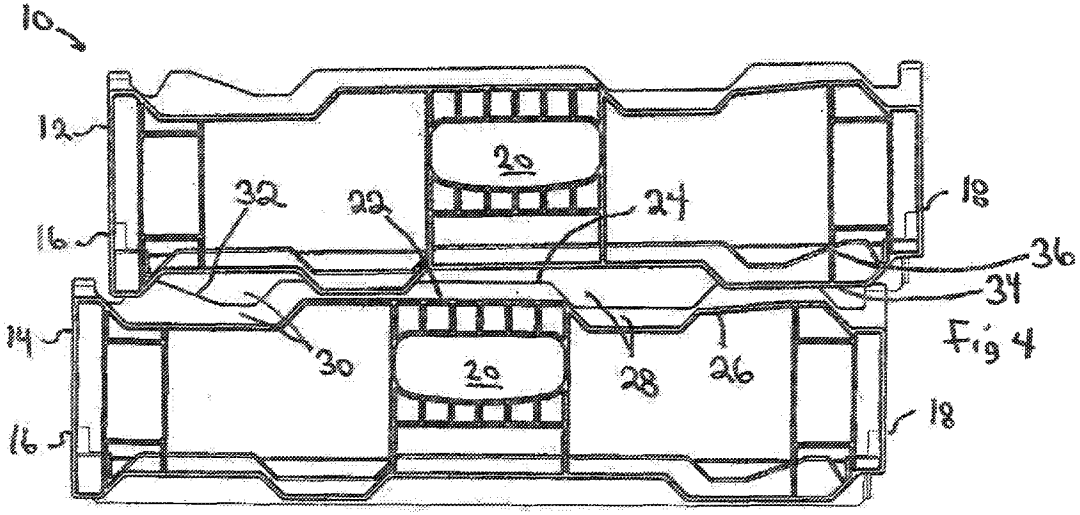
FIG. 4 is a side elevation view, in section, of a stacking tray in the higher operative position with top rail ramp engaged.

Sliding engagement 10 has a lower operative position illustrated in FIG. 1 and FIG. 2, and a higher operative position illustrated in FIG. 3 and FIG. 4. Referring to FIG. 1 and FIG. 2, overlying tray 12 slides along irregular top shelf 22 of underlying tray 14 in the lower operative position. Referring to FIG. 3 and FIG. 4, second bottom surface 36 of overlying tray 12 slides along irregular top rail 24 of underlying tray 14 which is raised above top shelf 22 in the higher operative position while first bottom surface 34 of overlying tray 12 slides along irregular top shelf 22 of underlying tray 14. Referring to FIG. 2, sliding engagement 10 includes a ramp 26 on top shelf 22 of underlying tray 14 which has an upwardly incline from break 28 toward second end 18 and which provides an inclined sliding transition in the lower operative position to lift first end 16 of overlying tray 12 as it slides along top shelf 22 in order to traverse break 28 in top shelf 22 and top rail 24. Referring to FIG. 3, sliding engagement 10 also includes a ramp 32 on top rail 24 of underlying tray 14 which has an upward incline from break 30 toward first end 16 and provides an inclined sliding transition to second end 18 of overlying tray 12 in the higher operative position to traverse break 30 in top rail 24 and top shelf 22 of underlying tray 14.

Operation:

Referring to FIG. 2, with the present sliding engagement 10 described above, ramp 26 on top shelf 22 enables overlying tray 12 to traverse break 28 in the lower operative position. Referring to FIG. 4, ramp 32 on top rail 24 enables overlying tray 12 to traverse break 30 in the higher operative position. Referring to FIG. 2, a "hand off" takes place in which ramp 26 on top shelf 22 helps lift first end 16 of overlying tray 12 onto top rail 24 when overlying tray 12 is traversing break 28 in top rail 24. Referring to FIG. 4, ramp 32 on the top rail 24 helps lift first end 16 of overlying tray 12 onto top shelf 22 when the overlying tray 12 is traversing break 30 in top shelf 22.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A two-position stacking delivery tray having a sliding engagement, the stacking delivery tray comprising:

a first end and a second end;

first and second top sliding surfaces and first and second bottom surfaces, each of the first and second top sliding surfaces and the first and second bottom surfaces having a first end and a second end, the first top sliding surface being a top shelf and the second top sliding surface being a top rail that is raised above the top shelf, the first and second top sliding surfaces comprising a series of peaks and valleys that extend between the first end and the second end of the stacking delivery tray, the sequence of peaks and valleys being asymmetric, the first and second bottom surfaces being complementary to the first and second top sliding surfaces, respectively, such that, in a stack of the stacking delivery trays, a first stacking delivery tray in the stack comprises an overlying stacking delivery tray and a second stacking delivery tray in the stack comprises an underlying stacking delivery tray that directly underlies the overlying stacking delivery tray, wherein a lower operative position is achieved by the bottom surfaces of the overlying stacking delivery tray engaging the valleys of the first and second top sliding surfaces of the underlying stacking delivery tray and a higher operative position is achieved by the bottom surfaces of the overlying stacking delivery tray engaging the peaks of the first and second top sliding surfaces of the underlying stacking deliver tray, the overlying stacking delivery tray sliding on a top surface of the first and second top sliding surfaces; and at least one inclined ramp on the first top sliding surface adjacent to an inclined surface of a valley on the second top sliding surface, each of the at least one inclined ramp and the inclined surface of the valley being inclined at an angle toward the first end of the stacking delivery tray, the angle of the at least one inclined ramp being less than the angle of the adjacent inclined surface of the valley, such that in operation, each inclined ramp engages an end of the overlying stacking delivery tray to provide an inclined sliding transition as the overlying tray slides on the second top sliding surface.

2. The two-position stacking delivery tray of claim 1, wherein the at least one inclined ramp is spaced from the first end of the stacking delivery tray.

3. The two-position stacking delivery tray of claim 1, further comprising;

at least one inclined ramp on the second top sliding surface adjacent to an inclined surface of a valley on the first top sliding surface, each of the at least one inclined ramp on the second top sliding surface and the inclined surface of the valley on the first top sliding surface being inclined toward the second end of the stacking delivery tray, the angle of each inclined ramp on the second top sliding surface being less than the angle of the adjacent inclined surface of the valley on the first top sliding surface, such that in operation, each inclined ramp on the second top sliding surface engages an end of the overlying stacking delivery tray to provide an inclined sliding transition as the overlying tray slides on the first top sliding surface.

* * * * *